United States Patent [19]

Otting et al.

[11] Patent Number: 4,580,304

[45] Date of Patent: Apr. 8, 1986

[54] METHOD OF DYEING CARPET

[75] Inventors: David L. Otting; Billy J. Otting, both of LaFayette, Ga.

[73] Assignee: Otting International, Inc., LaFayette, Ga.

[21] Appl. No.: 608,944

[22] Filed: May 10, 1984

Related U.S. Application Data

[63] Continuation-in-part of Ser. No. 585,439, Mar. 2, 1984.

[51] Int. Cl.[4] ..... D06B 1/02; D06B 21/00

[52] U.S. Cl. ..... 8/151; 8/158; 8/485; 8/929; 8/932; 68/205 R

[58] Field of Search ..... 8/151, 158, 929, 930, 8/483, 485, 499, 932, 934; 68/62, 205 R

[56] References Cited

U.S. PATENT DOCUMENTS 3,523,749 8/1970 MacLeod et al. ..... 8/929 X
4,361,019 11/1982 Maund ..... 68/62

FOREIGN PATENT DOCUMENTS 2009257 2/1970 Fed. Rep. of Germany ..... 8/483
1241820 8/1971 United Kingdom .
1479884 7/1977 United Kingdom ..... 8/929

*Primary Examiner*—Philip R. Coe
*Attorney, Agent, or Firm*—Alan Ruderman

[57] ABSTRACT

The method of dyeing a continuously moving carpet pile fabric with a base color and thereafter applying other color dyes onto the base color and fixing all of the dyes without the use of steam. The dyeing process employs a dye applicator to which a heated dye solution is supplied and this dye is sprayed onto the carpet while at a temperature of approximately 185° F. to 205° F. to provide the base color. The base color dye is applied with a wet pick-up of approximately 200 percent to 300 percent. Thereafter while the carpet is still hot from the wetting by the hot dye, other color dyes at substantially ambient temperatures are independently sprayed onto the carpet at spaced locations while the carpet is still in the temperature range of approximately 165° F. to 175° F. The total amount of additional dye applied subsequent to the base color dye provides a wet pick-up of approximately 120 percent. The base color dye is fixed substantially instantly, and each of the other dyes are fixed substantially on contact with the carpet.

13 Claims, 2 Drawing Figures

METHOD OF DYEING CARPET

BACKGROUND OF THE INVENTION

This application is a continuation-in-part of our copending U.S. application Ser. No. 585,439, filed Mar. 2, 1984.

This invention relates to the finish treatment of pile fabric such as carpet and more particularly to a method of dyeing the carpet with a base color and thereafter applying other colors to the carpet to obtain a printed effect without the use of steam.

As we pointed out in our aforesaid copending application entitled Method And Apparatus For Finishing Pile Fabric, until sometime in the late 1960's carpet was dyed by dipping a fixed length thereof into a large dye vat and oscillating the carpet back and forth a number of times. The dye in the vat was heated and the dye was fixed on the carpet while in the vat. The carpet was thereafter washed and dried before continuing the production process. Since this vat dyeing process resulted in an inefficient arresting of the carpet production a dye process was developed which permitted continuous lengths of carpet to be passed through dyeing and printing apparatus. However, in the practice of this process, which has been in existence now for some 17 years, large steamers had to be inserted after the dyeing process to heat the carpet and dye to a sufficient temperature in the presence of sufficient moisture to cause fixation of the dye onto the carpet. Because of the enormous length of the steamers required and the enormous amounts of energy utilized in the steamers the cost of dyeing carpet increased substantially as the cost of energy rose.

In our aforesaid patent application a method and apparatus is disclosed for dyeing and fixing a continuously moving web of carpet as the carpet is being dyed by dispensing a heated liquid dye onto the carpet at a temperature sufficient to fix the dye in the carpet material. The dyeing and fixing of the dye is accomplished by heating the dye prior to dispensing it onto the moving carpet, the temperature of the dye being sufficiently high to provide substantially instant fixation of the dye, and by continuously recirculating the dye through the distribution manifolds and back to the dye tank a uniform coloration across the carpet is obtained. By eliminating the need for the steamer previously used, the dye production line is substantially shortened while enormous reductions in energy utilization are attainable.

Inasmuch as solid color carpet comprises only a portion of the overall carpet market, and the process described in our aforesaid patent application applies a single color to the carpet, the desirability of producing dyed carpet having a printed look without the necessity of a steamer for fixing the dye is readily apparent. In the prior art various colors have been sprayed onto a carpet having the base color dye prior to fixation by a means of steam in the steamer. However, the novel process described in our aforesaid patent application eliminated the need for a steamer for solid color carpets and the advantages would be dissipated if a steamer is utilized for fixing the additional dyes subsequently applied for purposes of attaining a printed look.

SUMMARY OF THE INVENTION

Consequently, it is a primary object of the present invention to provide a method for dyeing a continuous moving web of pile fabric with a base color without the use of a steamer and thereafter applying other colors to the web to provide a printed affect and fixing these other colors without the use of a steamer.

It is another object of the present invention to provide a method of dyeing a moving web of carpet by wetting the web with a heated liquid dye to provide a base color and thereafter spraying liquified dye onto the wet web while the web remains heated by the heated liquid dye.

It is a further object of the present invention to provide a method of dyeing a moving web of carpet to provide a base color with a patterned affect having at least one other color thereon, the method including wetting the carpet with a dye of the base color heated to a temperature sufficient to fix the dye in the web material, and thereafter spraying dyes of the other colors individually onto the web while the temperature of the web remains sufficiently high so as to fix the other dyes in the carpet material.

Accordingly, the present invention provides a method in which a heated wetting solution is applied onto a moving web of textile material, the solution which preferably is a dye, is applied at a temperature sufficient to provide substantially instant fixation thereof so as to provide a base color to the web, and thereafter spraying at least one and preferably several separate liquified dyes of different colors onto the web before permitting the temperature of the web to drop substantially so that not only is the base color fixed, but also the dyes of the other colors are fixed by the temperature of the moving web.

The dye which provides the base color is heated and applied to the web which, in the specific application of the invention, is carpet, in a manner similar to that disclosed in our prior aforesaid patent application. Thereafter, the patterning colors are sprayed onto the carpet in seriatim at room temperature, the spraying stations being spaced apart and being in close proximity to the location at which the base color dye is applied so that the temperature of the web does not drop substantially below the temperature required for the dye fixation.

In the preferred form of the invention the hot base dye is applied at approximately 185° F. to 205° F., but the hotter the dye the quicker it will undergo fixation. Excellent results are obtained when the hot base color dye is applied with approximately a 200 percent to 300 percent wet pick-up, i.e., the weight of dye applied is 2 to 3 times the weight of the carpet. The temperature of the carpet at the time the pattern dyes are applied to the carpet ideally is in the range of at least approximately 165° F. to 175° F. and each pattern color is applied with a small wet pick-up compared to that of the base color. For example, when three pattern colors are applied the wet pick-up of each is in the order of 40 percent, e.g. 120 percent total wet pick-up for all these colors.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
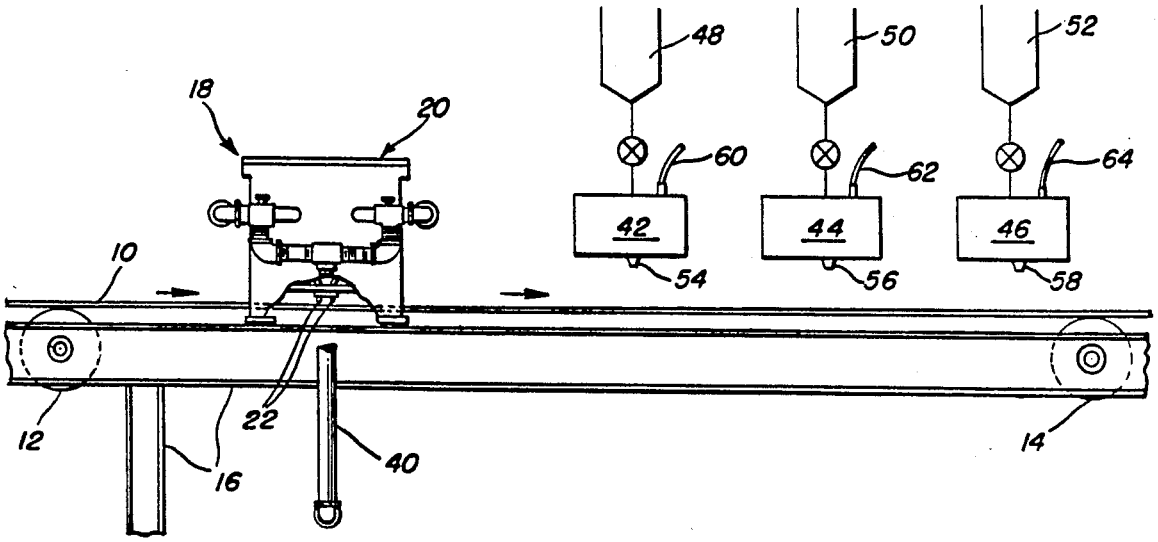
FIG. 1 is a side elevational view in diagramatic form of apparatus utilized in the practice of the process incorporating the principles of the present invention.
Figure 2:
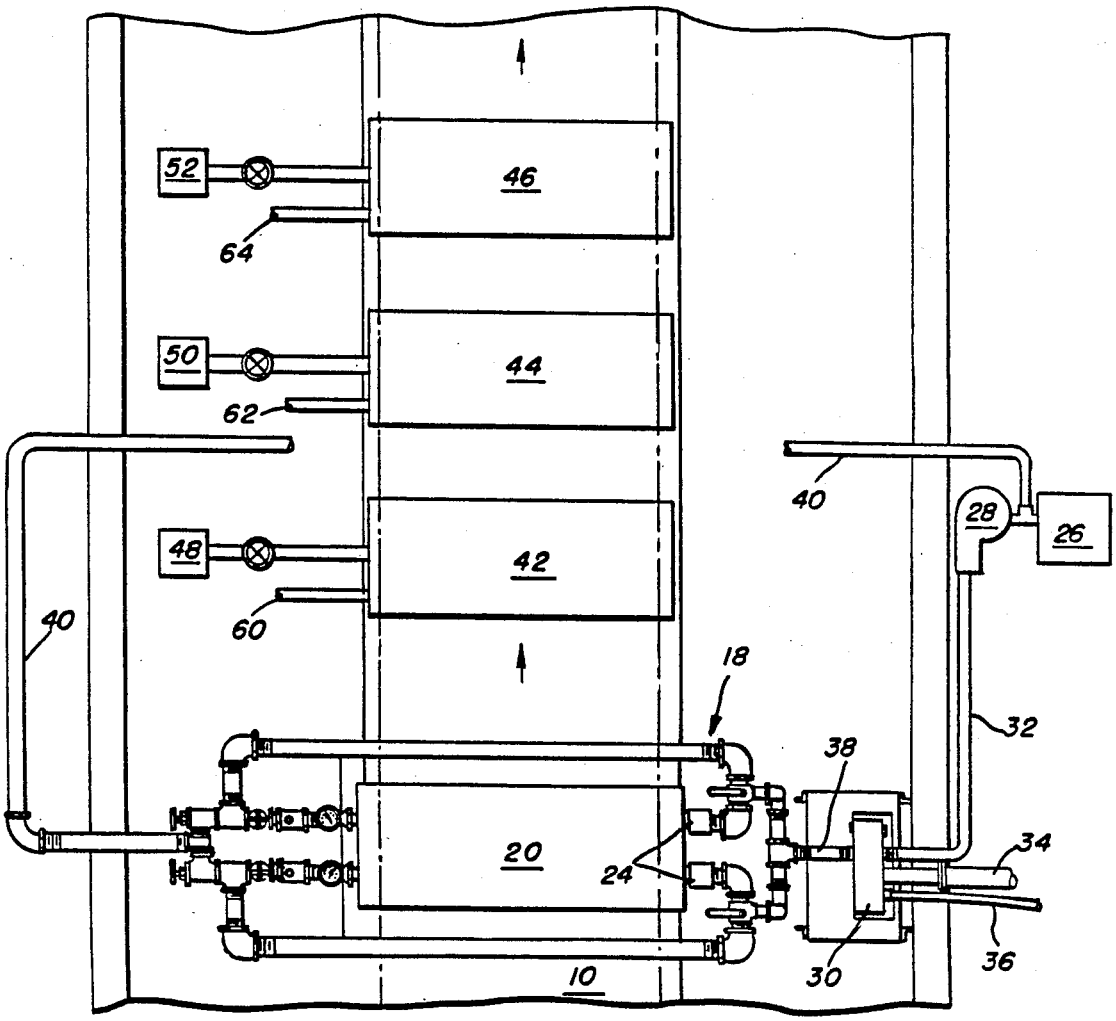
FIG. 2 is a diagramatic top plan view illustrating the process of FIG. 1 including portions of the hot dye system.

Referring now to the drawings the method of the present invention will be described in conjunction with apparatus for dyeing a moving web of carpet 10. The carpet is moved by feeding apparatus including rollers 12, 14 over a frame 16 first passing beneath the wetting spray of a hot dye station 18, the dye being sprayed onto the carpet at a temperature of approximately 185° F. to 205° F.

The dye section 18 includes a dye applicator 20 and associated dye heating apparatus such as disclosed in our aforesaid copending U.S. application Ser. No. 585,439. Thus, the dye applicator includes a series of nozzles 22 (only one being illustrated in the drawings) extending transversely across the width of the carpet which is fed with hot dye from at least one and preferably two manifolds 24, which may or may not be mixed with air to obtain a foaming action. The dye is supplied from a tank 26 to a pump 28 where it is pumped to a heat exchanger 30 through an inlet 32. The dye is heated by exchange of heat with a heating medium such as steam supplied to an inlet 34 of the heat exchanger and exits as a condensate through an outlet 36. The heated dye exits the heat exchanger through an outlet 38 at a temperature such that the temperature in the dye applicator manifolds preferably is in the order of approximately 208° F. to 220° F. The hot dye enters the dye applicator and that which is not sprayed onto the carpet is returned through piping 40 to the tank 26 and/or the pump 28.

The dye sprayed onto the carpet 10 by the applicator 20 is a solid color which provides a base color to the carpet. The amount of dye to thoroughly color the carpet is ideally in the range of approximately 200 percent to 300 percent wet pick-up, i.e., the weight of dye is two to three times the weight of the carpet. The carpet must be thoroughly wet and remain at a relatively high temperature for the subsequent step of the process.

Downstream of the hot dye applicator 20 and preferably in the order of 12 inches therefrom is at least one and preferably three other dye applicators 42, 44, 46. The number of such applicators depends upon the printed affect to be obtained so that more than three such applicators are conceivable, but probably not desirable. If more than one such applicator is utilized ideally it appears that they should be spaced about 36 inches apart. The dye is received by each applicator 42, 44, 46 from a respective tank 48, 50, 52, each storing a single color dye at room temperature. Each applicator may be, and preferably is, a jet foam applicator such as that disclosed in copending U.S. patent applications Ser. Nos. 391,468 filed June 23, 1982, and now U.S. Pat. No. 4,501,038, and 469,643 filed Feb. 25, 1983, and now Pat. No. 4,485,508 by Billy J. Otting one of the coinventors of the present invention and assigned to the common assignee thereof. Thus, each applicator 42, 44, 46 includes a transverse series of nozzles 54, 56, 58 (only a single one of each being illustrated) which sprays aerated foam dye onto the carpet, the air being supplied under pressure through piping 60, 62, 64 respectively.

The first ambient room temperature applicator 42 should spary its dye onto the carpet while the carpet is at the high end of the temperature range of 165° F. to 175° F. and each succeeding dye sprayed thereon preferably strikes the carpet while the carpet is in this temperature range. The principle is that each dye strikes the carpet while the carpet is still hot enough for the dye to set. As was disclosed in detail in our aforesaid copending application Ser. No. 585,439 the hot dye sets substantially instantly. Now we have developed a patterning process where room temperature color dyes are subsequently sprayed onto the carpet while the latter is hot and these room temperature dyes are set also substantially on contact with the carpet. Excellent results have been found when the amount of dye sprayed onto the carpet which has been wetted by 200 to 300 percent wet pick-up of hot dye is approximately 40 percent wet pick-up for each color when three colors are applied, i.e., 120 percent wet pick-up for all three. Thus, it appears that 120 percent wet pick-up of ambient temperature dye subsequent to the hot dye may be ideal. The pH of all the dyes should be in the range of approximately three to six.

It will be obvious to those skilled in the art that many variations may be made in the embodiment chosen for purposes of illustrating the invention. For example, since the room temperatue dyes are set when contacting carpet heated by hot dye, they will also set when contacting carpet or other web material wetted by any hot liquid. However, all such modifications which do not depart from the spirit of the invention are intended to be included within the scope of the appended claims.

Having thus set for th the nature of the invention, what is claimed herein is:

1. A method of dyeing a moving web of pile fabric material comprising:

a. heating a liquid dye of a first color;

b. spraying the heated liquid dye onto the web at a wetting station to wet and heat the web, the weight of the dye being greater than the weight of the web; and c. spraying an additional liquid dye of a different color than said first color onto the wet web at a subsequent station spaced from the wetting station before permitting the temperature of the web to drop substantially, so as to set the additional liquid dye on the wet web.

2. The method as recited in claim 1, wherein said web comprises carpet.

3. The method as recited in claim 2, wherein the weight of said heated liquid dye applied onto said carpet comprises approximately two to three times the weight of said carpet.

4. The method as recited in claim 2, wherein the temperature of said heated liquid dye applied to said carpet is at least approximately 180° F. to 205° F.

5. The method as recited in claim 4, wherein the weight of said heated liquid dye applied onto said carpet comprises approximately two to three times the weight of said carpet.

6. The method as recited in claim 4, wherein the temperature of the additional liquid dye is substantially ambient temperature.

7. The method as recited in claim 6, wherein said additional liquid dye is sprayed onto said carpet while said carpet is at a temperature of at least approximately 165° F. to 175° F.

8. The method as recited in claim 6, wherein said additional dye is sprayed onto the carpet at more than one subsequent station spaced downstream from the wetting station, and at each subsequent station the dye sprayed has a different color.

9. The method as recited in claim 8, wherein the weight of said heated liquid dye applied onto said carpet comprises approximately two to three times the weight of said carpet.

10. The method as recited in claim 9, wherein the total weight of said additional dye is substantially less than the weight of said heated dye.

11. The method as recited in claim 10, wherein there are three subsequent additional dye stations spaced from the wetting station, each additional dye station spraying dye equal in weight to approximately 40 percent of the weight of said carpet.

12. The method of dyeing a moving web of carpet to provide a base color with a patterned affect having at least one other color thereon, said method comprising, heating a dye of the base color, spraying said carpet with said dye to wet and heat said carpet while said dye is at a temperature of at least approximately 185° F. to 205° F., and spraying a dye having said one other color onto said carpet while said carpet remains wet and is at a temperature of at least approximately 165° F. to 175° F.

13. The method as recited in claim 12, wherein the temperature of said one other dye is ambient.

* * * * *